United States Patent [19]

Tonooka et al.

[11] Patent Number: 4,859,191

[45] Date of Patent: Aug. 22, 1989

[54] MULTI-PIECE CONNECTOR ASSEMBLY

[75] Inventors: Takashi Tonooka; Toshimitsu Katsumata, both of Shizuoka, Japan

[73] Assignee: Texas Instruments Incorporated, Dallas, Tex.

[21] Appl. No.: 53,977

[22] Filed: May 22, 1987

[30] Foreign Application Priority Data

May 30, 1986 [JP] Japan ..... 61-125453

[51] Int. Cl.[4] ..... H01R 9/09

[52] U.S. Cl. ..... 439/79; 439/680

[58] Field of Search ..... 439/64, 65, 78–83, 439/325, 680

[56] References Cited

U.S. PATENT DOCUMENTS 3,351,894 11/1967 Kinkaid ..... 439/79
4,579,412 4/1986 Czeschka et al. ..... 439/680
4,580,858 4/1986 Daberkoe ..... 439/62

FOREIGN PATENT DOCUMENTS 01540 4/1983 Sweden ..... 439/79

OTHER PUBLICATIONS

Berg Pv Connector Systems Bulletin 1000, No. 1012.0, 1013.0,; Typical PV/Housings Applications Sep. 1978, Berg Electronics.

*Primary Examiner*—P. Austin Bradley
*Attorney, Agent, or Firm*—James P. McAndrews; John A. Haug; Melvin Sharp

[57] ABSTRACT

A multi-piece connector assembly comprising a first interconnect member having a plurality of contact pins, and a second interconnect member having a plurality of apertures, the first and second interconnect members being matingly engageable with each other for allowing desired ones of the contact pins to be fitted into desired ones of the apertures. The mating engagement between the two interconnect members is achieved without involving deformation of each of the interconnect members or removal of any of the contact pins from the first interconnect member.

1 Claim, 5 Drawing Sheets

MULTI-PIECE CONNECTOR ASSEMBLY

FIELD OF THE INVENTION

The present invention relates to connector assemblies for electric systems and equipment and, more particularly, to multi-piece or, typically, two piece connector assemblies for use with printed circuit boards for computer systems.

BACKGROUND OF THE INVENTION

In a computer system such as a personal computer, a card-edge connector assembly is used for providing electrical connection between a main wiring board and an optional wiring board. Typical of such a connector assembly is a two-piece assembly which consists of plug and socket members to be coupled together between main and optional wiring boards. Problems are encountered by such a two-piece connector assembly principally because of the fact that prior-art two-piece connector assemblies manufactured on a standardized, large-scale production basis are ordinarily such that the plug and socket members of a connector assembly share in the the number of contact pins with each other. The present invention contemplates provision of an improved connector assembly free from such problems.

SUMMARY OF THE INVENTION

In accordance with the present invention, there is provided a multi-piece connector assembly comprising a first interconnect member of an electrical insulator, the first interconnect member having a plurality of contact pins, and a second interconnect member of an electrical insulator, the second interconnect member having a plurality of apertures, the first and second interconnect members being matingly engageable with each other for allowing desired ones of the contact pins to be fitted into desired ones of the apertures, the mating engagement between the first and second interconnect members being achieved without involving deformation of each of the interconnect members and removal of any of the contact pins from the first interconnect member. In a multipiece connector assembly thus constructed, the number of the contact pins on the first interconnect member is either not less or not greater than the number of the apertures in the second interconnect member.

BRIEF DESCRIPTION OF THE DRAWINGS

The drawbacks of a prior-art connector assembly and the features and advantages of a connector assembly according to the present invention will be more clearly understood from the following description taken in conjunction with the accompanying drawings in which like reference numerals designate similar or corresponding members and elements and in which.

DESCRIPTION OF THE PRIOR ART

Figure 1:
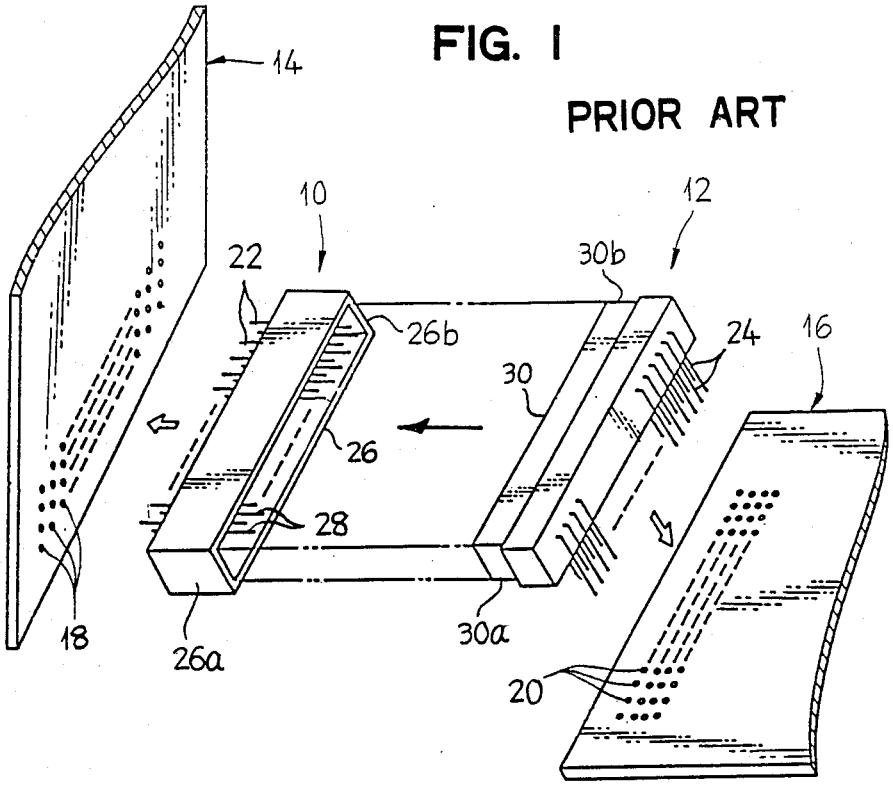
FIG. 1 PRIOR ART
FIG. 1 is a view showing a typical example of a known two-piece connector assembly of the type to which the present invention generally appertains, the connector assembly being shown arranged in combination with a main wiring board and an optional wiring board.
Figure 2:
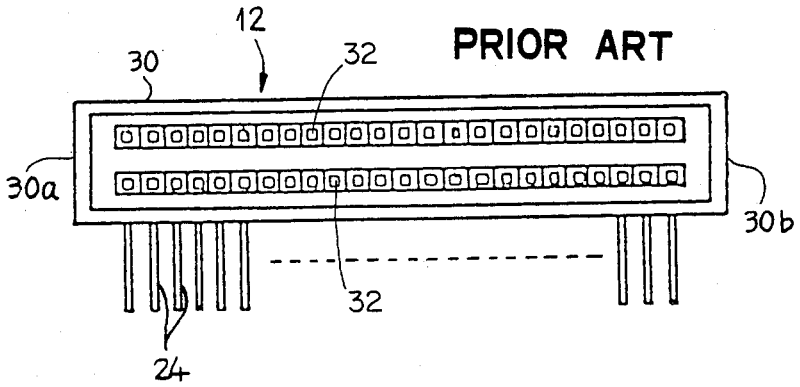
FIG. 2 PRIOR ART
FIG. 2 is a longitudinal sectional view of the socket member forming part of the prior-art connector assembly shown in FIG. 1.

In FIG. 1 is shown a typical example of a known two-piece connector assembly of the card-edge type which consists of a plug member 10 and a socket member 12 each of an electrically insulating material and which is to be used in combination with a main wiring board 14 and an optical wiring board 16. The plug member 10 is for being coupled to the main wiring board 14 provided with apertures 18 arranged in rows, and the socket member 12 for being coupled to the optional wiring board 16 which is likewise provided with apertures 20 arranged in rows. The plug member 10 has a number of contact pins 22 arranged in rows for being respectively inserted into the apertures 18 in the main wiring board 14. The socket member 12 also has a number of contact pins 24 arranged in rows for being respectively inserted into the apertures 20 in the optional wiring board 16. The plug member 10 further has a hollow receptacle portion 26 within which a number of contact pins 28 extend in opposite directions to the pins 22, while the socket member 12 has a socket portion 30 formed with a number of apertures 32 arranged in rows as shown in FIG. 2. The socket portion 30 of the socket member 12 is to be snugly received in the receptacle portion 26 of the plug member 10 with the pins 28 on the plug member 10 respectively fitted into the apertures 32 in the socket member 12.

The contact pins 22, 24 and 28 provided on such a two-piece connector assembly consist of those allocated to the basic functions of the computer system to which the connector assembly is to be applied and those allocated to optional functions of the computer system. The pins allocated to the basic functions are common in number between the plug and socket members 10 and 12 but the pins allocated to the optional functions are usually larger in number on the socket member 12 than on the plug member 10. Thus, the socket member 12 to be coupled to the optional wiring board 16 is required to have a larger number of contact pins than the plug member 10 to be coupled to the main wiring board 14. If, for example, it is assumed that the plug member 10 should have twenty pins and the socket member 12 thirty pins, it is required to use either a custom-made connector assembly having such plug and socket members or a standard connector assembly composed of plug and socket members each originally having thirty pins with the surplus ten of the pins plucked out or cut off from the socket member 12. The use of a customer-made connector assembly results in a penalty of high production cost, while the use of a standard connector assembly with the surplus pins removed not only requires additional time and labor for the removal of the pins but would lead to creation of objectionable voltages at the locations of the socket member from which the surplus pins have been removed. These problems are invited basically by reason of the fact that prior-art two-piece connector assemblies manufactured on a standardized basis are ordinarily such that the plug and socket members of a connector assembly have equal numbers of contact pins. The goal of the present invention is to provide a useful solution to such problems as previously noted.

DESCRIPTION OF THE PREFERRED EMBODIMENTS

Description will now be made with reference to FIG. 3, in which a two-piece connector assembly embodying the present invention is shown comprising a combination of first and second interconnect members each of an electrical insulator. These first and second interconnect members are respectively provided by a plug member 10 and a socket member 12 which are basically similar to their respective counterparts of the prior-art connector assembly described with reference to FIGS. 1 and 2. Thus, the plug and socket members 10 and 12 as the first and second interconnect members are also to be coupled together between a main wiring board and an optional wiring board which are not herein shown. By preference, one of the plug and socket members 10 and 12 is formed with a cutout 34 which is shown formed in the plug member 10 and the other of the plug and socket members is formed with a projection 36 which is shown formed on the socket member 12. Proper mating engagement can thus be achieved between the two members 10 and 12 with the projection 36 of the socket member 12 fitted into the cutout 34 in the plug member 10. The plug member 10 has a set of contact pins 22 on one side and a set of contact pins 28 on the other side. For purposes of description, the pins 28 to be fitted to the socket member 12 are numbered $28_0$, $28_1$, $28_2$, . . . $28_k$, . . . $28_m$, $28_{n-1}$. Of these n number of contact pins $28_0$ to $28_{n-1}$, the pins $28_k$ to $28_m$ are assumed to be allocated to the basic functions of the computer system to which the connector assembly is to be applied. The socket member 12 is shown having three different variants 12*a*, 12*b* and 12*c* by way of example.

Figure 3:
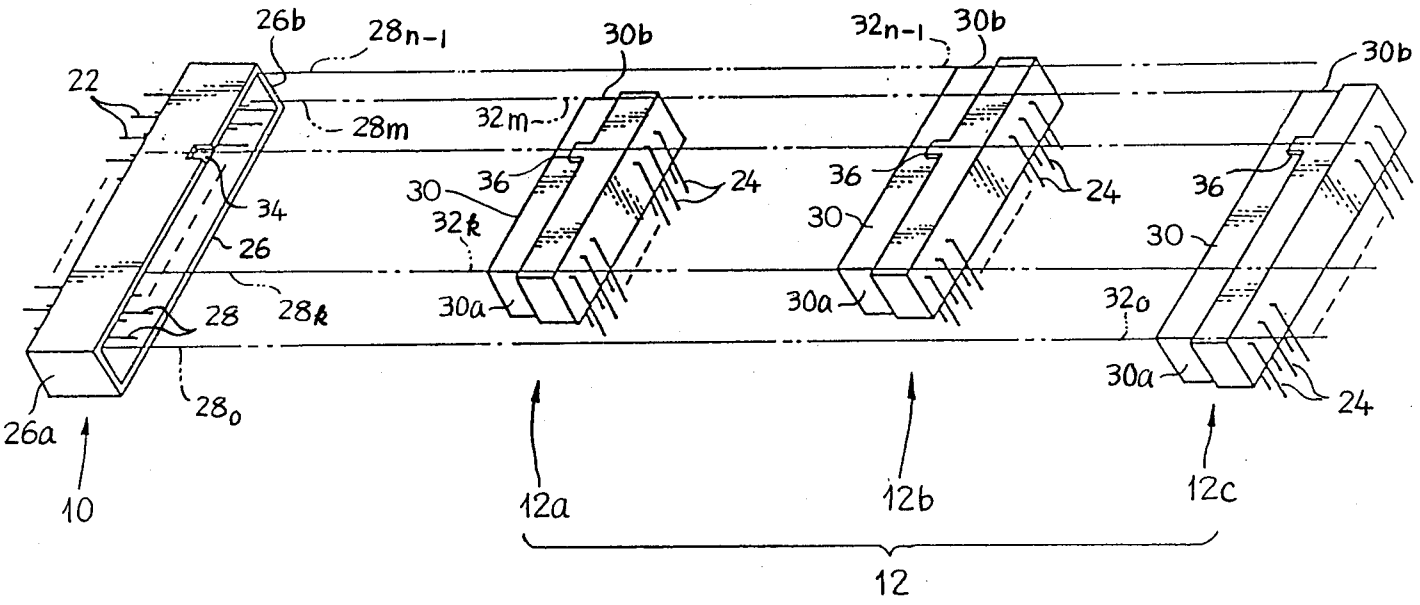
FIG. 3 is a view showing a first preferred embodiment of a connector assembly according to the present invention.

In the embodiment of the present invention shown in FIG. 3, the variants 12*a*, 12*b* and 12*c* of the socket member 12 have different longitudinal measurements and are provided with different numbers of apertures to receive the pins 28 on the plug member 10. The plug member 10 is designed and manufactured so that the number of the pins 28 provided thereon is not less than the number of the apertures provided in each of the variants 12*a*, 12*b* and 12*c* of the socket member 12. The first variant 12*a* of the socket member 12 has a predetermined number of apertures $32_k$ to $32_m$ which are to receive the pins $28_k$ to $28_m$, respectively, out of the n number of pins $28_0$ to $28_{n-1}$ on the plug member 10. All the apertures of the variant 12*a* are thus allocated to the basic functions of the computer system to which the connector assembly is to be applied. The second variant 12*b* of the socket member 12 has a perdetermined number of apertures $32_k$ to $32_{n-1}$ which are to receive the pins $28_k$ to $28_{n-1}$, respectively, on the plug member 10 with the apertures $32_{m+1}$ to $32_{n-1}$ allocated to the optional functions of the computer system. The third variant 12*c* of the socket member 12 has a predetermined number of apertures $32_0$ to $32_m$ which are to receive the pins $28_0$ to $28_m$, respectively, on the plug member 10 with the apertures $32_0$ to $32_{k-1}$ allocated to the optional functions of the computer system. Thus, any one of the different variants 12*a*, 12*b* and 12*c* of the socket member 12 can be selectively coupled to the plug member 10 without removing surplus pins, if any, from the plug member 10. It may be noted that, in the first preferred embodiment of the present invention, the plug member 10 has end walls 26*a* and 26*b* at the opposite ends of the receptacle portion 26 and, likewise, the socket member 12 has end walls 30*a* and 30*b* at the opposite ends of the socket portion 30 thereof.

Figure 4:
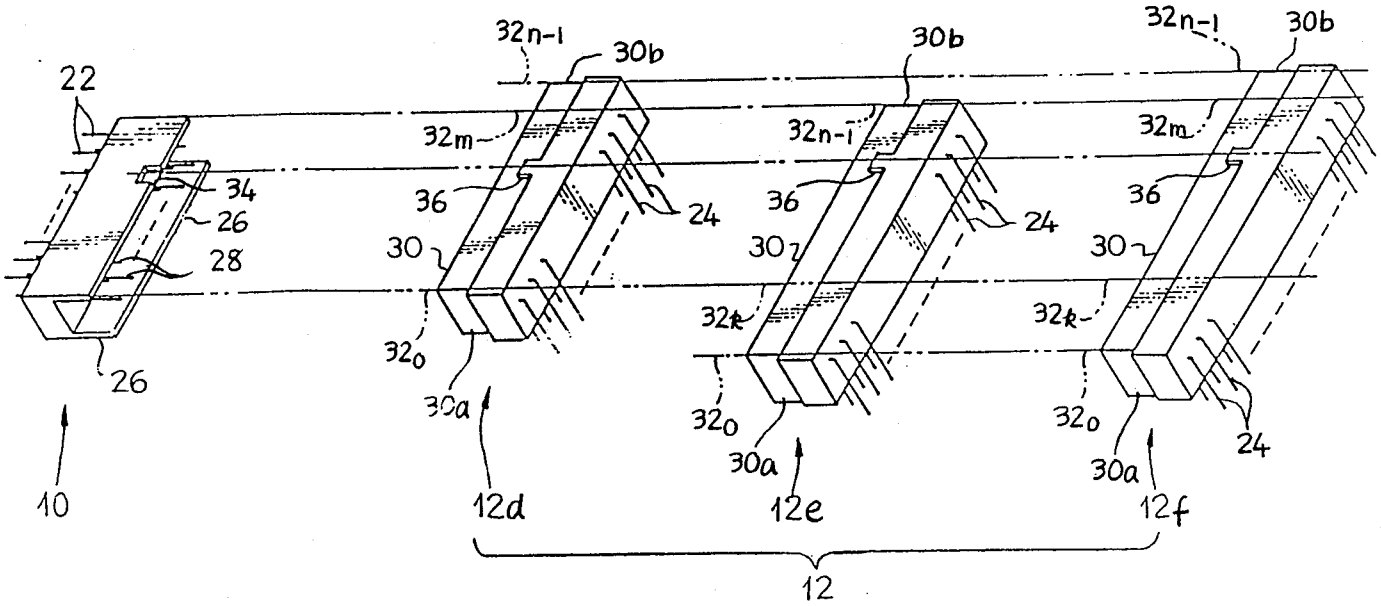
FIG. 4 is a view showing a second preferred embodiment of a connector assembly according to the present invention.

FIG. 4 shows a second preferred embodiment of the present invention wherein the socket member 12 is also shown having variants 12*d*, 12*e* and 12*f* with different numbers of apertures. The connector assembly herein shown is characterized firstly by the plug member 10 which is provided with the contact pins 28 in a number not more than the number of the apertures in each of the variants 12*d*, 12*e* and 12*f* of the socket member 12. All of the pins 28 of such a plug member 10 are assumed to be allocated to the basic functions of the computer system to which the connector assembly is to be applied. The connector assembly shown in FIG. 4 is further characterized in that the receptacle portion 26 of the plug member 10 has no end walls so that the plug member 10 is open at both longitudinal ends of the receptacle portion 26.

In this second preferred embodiment of the present invention, the first variant 12*d* of the socket member 12 has a predetermined number of apertures $32_0$ . . . $32_m$ . . . $32_{n-1}$ out of which the apertures $32_0$ to $32_m$ are to receive the pins 28 on the plug member 10. In this instance, the end portion of the socket member 12 in which the surplus apertures $32_{m+1}$ to $32_{n-1}$ are disposed extends outwardly from the plug member 12 through one open end of the receptacle portion 26 of the plug member 10. The second variant 12*e* has a predetermined number of apertures $32_0$ . . . $32_k$ . . . $32_{n-1}$ out of which the apertures $32_k$ to $32_{n-1}$ are to receive the pins 28 on the plug member 10. The end portion of the socket member 12 in which the surplus apertures $32_0$ to $32_{k-1}$ are disposed extends outwardly from the plug member 12 through the other open end of the receptacle portion 26. The third variant 12*f* of the socket member 12 has a predetermined number of apertures $32_0$ . . . $32_k$ . . . $32_m$ . . . $32_{n-1}$ out of which the apertures $32_k$ to $32_m$ are to receive the pins 28 on the plug member 10. The opposite end portions of the socket member 12 in which the surplus apertures $32_0$ to $32_{k-1}$ and $32_{m+1}$ to $32_{n-1}$ are disposed extend outwardly from the plug member 12 respectively through the opposite open ends of the receptacle portion 26. Thus, any one of the different variants 12*d*, 12*e* and 12*f* of the socket member 12 can be selectively coupled to the plug member 10 without removing surplus pins from the socket member 12. It may be noted that each of the socket member 12 of the second preferred embodiment of the present invention has end walls 30*a* and 30*b* at the opposite ends of the socket portion 30 thereof.

Figure 5:
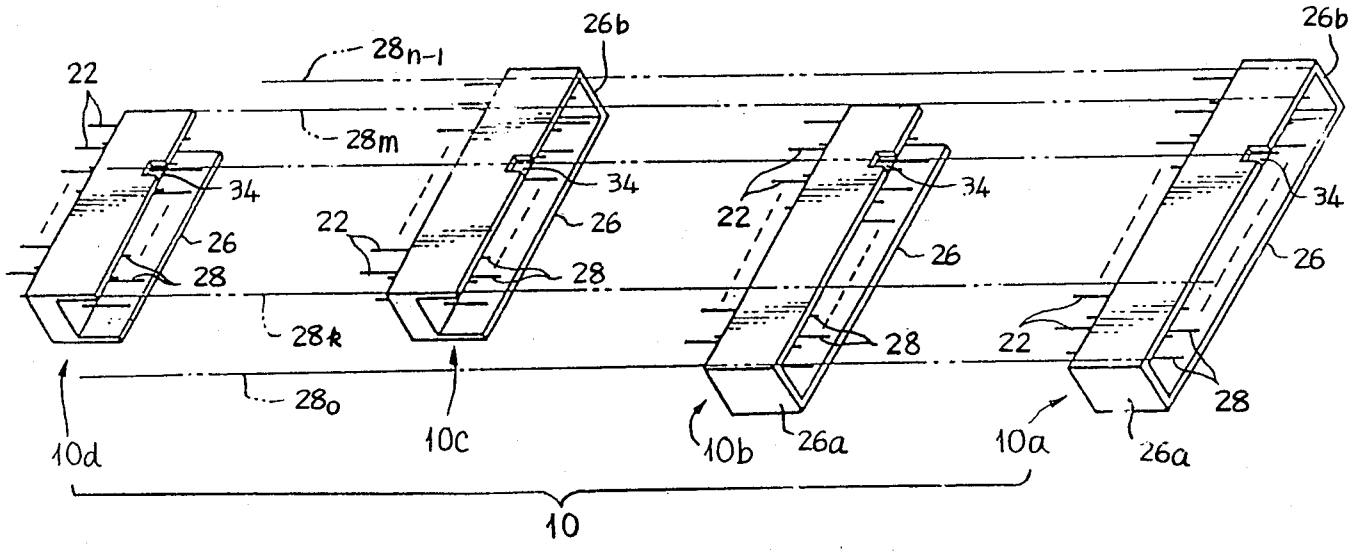
FIG. 5 is a view showing some difference variants of the plug member forming part of a connector assembly according to the present invention.

FIG. 5 shows some different variants 10*a*, 10*b*, 10*c* and 10*d* of the plug member 10 which forms part of a connector assembly according to the present invention. The variant 10*a* shown to the right of the drawing has end walls 26*a* and 26*b* at the opposite ends of the receptacle portion 26 thereof and is thus similar to the plug member 10 in the embodiment shown in FIG. 3. The variant 10*d* of the plug member 10 as shown to the left of the drawing is open at the opposite ends of the receptacle portion 26 thereof and is thus similar to the plug member 10 in the embodiment shown in FIG. 4. Each of the remaining two variants 10*b* and 10*c* of the plug member 10 is open at one end of the receptacle portion 26 and is closed by an end wall 26*a* or 26*b* at the other end of the receptacle portion 26 of the plug member 10 as shown. The socket member (not shown) can thus be fitted to the variant 10*b* or 10*c* of the plug member 10 with one of its end portion projecting outwardly from the plug member 10 through the open and of the receptacle portion 26 of the plug member 10.

As will have been understood from the foregoing description, the plug member of a connector assembly according to the present invention can be designed and manufactured on a standardized basis and is compatible with a socket member having any number of apertures, thus permitting significant reduction in the production cost of connector assemblies for computer systems. The apertures in the socket member to mate with such a plug member may be either no more than the contact pins on the plug member as in the embodiment of FIG. 3 or no less than the pins on the plug member as in the embodiment of FIG. 4.

Figure 6A:
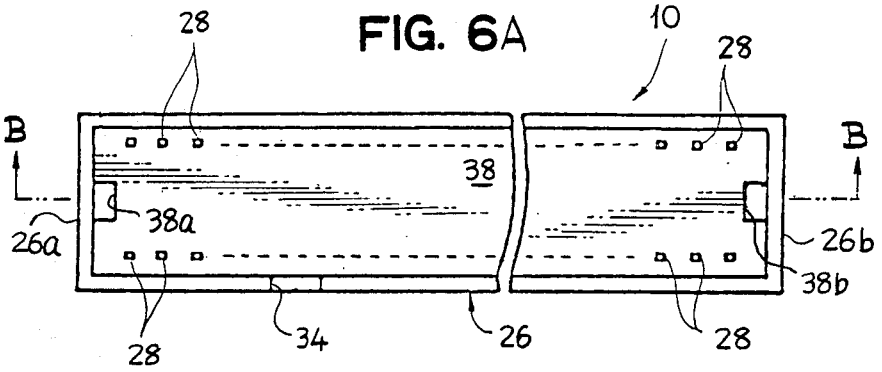
FIG. 6A is a fragmentary plan view of the plug member forming part of a third preferred embodiment of a connector assembly according to the present invention.
Figure 6B:
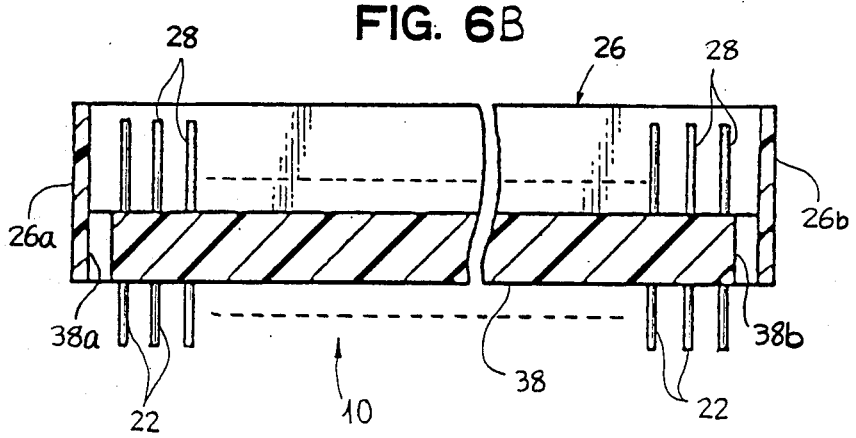
FIG. 6B is a sectional view taken along line B—B in FIG. 6A.

FIGS. 6A and 6B show the plug member of another preferred embodiment of a connector assembly according to the present invention. The plug member herein shown is improved to be of advantage when soldered to a main wiring board using the known vapor-phase solder reflow techniques. Such a plug member, also represented by numeral 10, is shown having a flat base portion 38 extending between the opposite end walls 26*a* and 26*b* of the receptacle portion 26 of the plug member 10. The contact pins 22 to be fitted to the main wiring board (not shown) project from the outer face of this base portion 38 and the contact pins 28 to be fitted to the socket member (not shown) project from the inner face of the base portion 38 as shown. During the process in which the plug member 10 is being soldered to the main wiring board by the vapor-phase solder reflow techniques, the process liquid (which is typically inactive chemical liquor) used for soldering tends to collect on the surface of the base portion 38 as well known in the art. The liquid in the solder bath is thus allowed to partially flow from the bath to the plug member 10 and this requires meticulous control over the liquid stored in the bath and the possible hazards on human bodies.

In accordance with the present invention, the base portion 38 of the plug member 10 is thus formed with two drain openings 38*a* and 38*b* located adjacent the end walls 26*a* and 26*b*, respectively, of the receptacle portion 26, each of the openings being open at the inner and outer faces of the base portion 38. With the provision of such openings 38*a* and 38*b* in the base portion 38, the process liquid which tends to collect on the inner face of the base portion 38 is allowed out of the plug member 10 back to the solder bath through these openings 38*a* and 38*b*. To facilitate liquid to flow into the openings 38*a* and 38*b*, the base portion 38 may be configured so that the inner face thereof is slightly inclined toward the openings 38*a* and 38*b*. The number, locations and cross sectional shapes of the drain openings herein shown are merely by way of example and may thus be varied as desired. While it is preferable that the connector assembly having such openings in the base portion of the plug member have the features described with reference to FIG. 3, 4 or 5, such openings may be provided in the plug member of any of card-edge connector assemblies or in an IC (integrated circuit) socket device. Alternatively to the formation of the openings 38*a* and 38*b* in the base portion 38, the drain opening or openings may be provided by the hole or holes through which any one or more of the contact pins 22 and 28 are to be affixed to the base portion 38. For this purpose, the hole or holes through which the particular contact pin or pins are to be affixed to the base portion 38 are formed to have larger cross sectional areas than the holes for the other pins of the plug member 10.

While a few preferred embodiments of a connector assembly according to the present invention have been described and shown, such embodiments are merely for the purpose of description and may be modified in numerous manners. Such modifications may be made in regard to the geometry (shape and relative measurements) of each of the plug and socket members 10 and 12, the manner in which the plug and socket members 10 and 12 are to be coupled together, and/or the manner in which each of the plug and socket members 10 and 12 is to be coupled to the respectively associated wiring board 14 and 16. The plug and socket members 10 and 12 have been described as being attached to the main and optional wiring boards 14 and 16, respectively, but may be attached conversely to the optional and main wiring boards 16 and 14, respectively. While, in addition, each of the embodiments described with reference to FIGS. 3 to 5 is such that the plug member 10 is common to a plurality of variants of the socket member 12, a connector assembly according to the present invention may has its socket member used commonly to a plurality of variants of the plug member. It will also be understood that the described features of a connector assembly proposed by the present invention are applicable not only to a two-piece connector assembly but generally to a multi-piece connector assembly having three or more component members which are to be coupled together with electrical connections provided therebetween.

What is claimed is:

1. A multi-piece connector assembly comprising (a) a first interconnect member of an electrical insulator, the first interconnect member having a plurality of contact pins, and (b) a second interconnect member of an electrical insulator, the second interconnect member having a plurality of apertures, (c) the first and second interconnect members being matingly engageable with each other for allowing desired ones of said contact pins to be fitted into desired ones of said apertures, the mating engagement between the first and second interconnect members being achieved without involving deformation of each of the interconnect members and removal of any of said contact pins from said first interconnect member, and (d) in which each of said first and second interconnect members is elongated and in which said contact pins are arranged in at least one row longitudinally of said first interconnect member and said apertures are arranged in at least one row longitudinally of said second interconnect member, wherein at least one of said first and second interconnect members has a receptacle portion which is open in at least one of the opposite longitudinal ends of the interconnect member and the other interconnect member has a base portion to fit partly within said receptacle portion so that one of the first and second interconnect members is allowed to longitudinally extend beyond the open end of the receptacle portion of the other.

* * * * *